US007693452B2

(12) United States Patent
Kaiho et al.

(10) Patent No.: US 7,693,452 B2
(45) Date of Patent: Apr. 6, 2010

(54) TRANSFER BELT UNIT AND METHOD FOR HOLDING THE SAME

(75) Inventors: Satoshi Kaiho, Kanagawa-ken (JP); Naoki Yamamura, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 159 days.

(21) Appl. No.: 11/694,570

(22) Filed: Mar. 30, 2007

(65) Prior Publication Data

US 2007/0231001 A1 Oct. 4, 2007

(30) Foreign Application Priority Data

Mar. 30, 2006 (JP) ..... 2006-093924

(51) Int. Cl.
*G03G 15/08* (2006.01)
*G03G 15/00* (2006.01)

(52) U.S. Cl. ..... 399/121

(58) Field of Classification Search ..... 399/121, 399/107, 110, 297

See application file for complete search history.

(56) References Cited

U.S. PATENT DOCUMENTS

| | | | | |
|---|---|---|---|---|
| 6,522,848 | B2 * | 2/2003 | Wakana | 399/121 |
| 2001/0051059 | A1 * | 12/2001 | Morikami et al. | 399/121 |
| 2005/0169667 | A1 * | 8/2005 | Katoh | 399/121 |

FOREIGN PATENT DOCUMENTS

| | | |
|---|---|---|
| JP | 2000-275987 | 10/2000 |

* cited by examiner

*Primary Examiner*—David M Gray
*Assistant Examiner*—Billy J Lactaoen
(74) *Attorney, Agent, or Firm*—Turocy & Watson, LLP

(57) ABSTRACT

A transfer belt unit which is mounted in an image forming device. The transfer belt unit contains a positioning member; a handle, and a guiding member. The positioning member positions the transfer belt unit with respect to the image forming device in a state where the transfer belt unit is inserted into a guide unit. The handle is placed on the rear side of the positioning member in a direction of inserting the transfer belt unit into the guide unit. The guiding member holds the transfer belt unit when the transfer belt unit is inserted into the guide unit by abutting on a guide surface of the guide unit together with the positioning member before the handle is inserted into the guide unit.

12 Claims, 4 Drawing Sheets

TRANSFER BELT UNIT AND METHOD FOR HOLDING THE SAME

BACKGROUND OF THE INVENTION

1. Field of the Invention

The present invention relates to a transfer belt unit mounted in an image forming device. In particular, the present invention relates to a mounting technique in which the transfer belt unit is inserted almost horizontally into and mounted in the image forming device.

2. Description of the Related Art

FIG. 5 is a schematic diagram for describing mounting of a conventional transfer belt unit in an image forming device. A transfer belt unit 200 has a substantially rectangular parallelepiped form, and a handle 35 (45) is placed on both of side surfaces near the center of the transfer belt unit where the weight of the transfer belt unit is balanced. When the transfer belt unit 200 is mounted in the image forming device, the transfer belt unit is inserted from the front surface of insertion of the transfer belt unit 200 to a unit inserting port 5 of the image forming device in a direction shown by an arrow DN. After the transfer belt unit 200 is moved to a normal position, the transfer belt unit is positioned (normally, fixed by being pressed down) at an operating position and is put into operation.

In the case described above, guide rails 60 and 70 having a cross-sectional surface of "U-shape" which extends from the unit inserting port 5 to inside are placed in the image forming device. The openings of the "U-shape" of the guide rails 60 and 70 are placed so that these openings face each other. On both of side surfaces of the transfer belt unit 200 near the front surface of the inserting direction and the rear surface of the inserting direction, positioning axes 31 and 41 and positioning axes 32 and 42 are placed, respectively. Therefore, insertion of the transfer belt unit 200 is carried out by putting the positioning axes 31, 32, 41, and 42 through the guide rails 60 and 70.

As described above, in the conventional transfer belt unit, when insertion and positioning of the transfer belt unit 200 are carried out, the transfer belt unit may fall out from the unit insertion port if the operator stops holding the transfer belt unit and releases the transfer belt unit from his or her hand in the insertion state as shown in FIG. 5, since there is nothing that holds the transfer belt unit near the rear surface in the inserting direction of the transfer belt unit and an orientation of the transfer belt unit is rotated to the direction of the arrow DF with the positioning axis 31 (41) as a rotational axis. For this reason, there has been a problem in an aspect of operability that the operator has to insert the transfer belt unit by taking into consideration an attitude of the transfer belt unit when the operator mounts the transfer belt unit in the image forming device.

SUMMARY OF THE INVENTION

An object of an embodiment of the present invention is to provide a technique capable of contributing to improvement of operability when a transfer belt unit is mounted in an image forming device.

In order to achieve the object described above, according to an aspect of the present invention, there is provided a transfer belt unit, which is mounted in an image forming device by being inserted in a predetermined direction in a guide unit provided in the image forming device and extending to the predetermined direction, the transfer belt unit comprising: a positioning member that positions the transfer belt unit with respect to the image forming device in a state where the transfer belt unit is inserted into the guide unit; a handle that allows a user to grasp the transfer belt unit when the transfer belt unit is inserted into the guide unit, the handle being placed on the rear side of the positioning member in a direction of inserting the transfer belt unit into the guide unit; and a guiding member that holds the transfer belt unit with respect to the image forming device when the transfer belt unit is inserted into the guide unit by abutting on a guide surface of the guide unit together with the positioning member before the handle is inserted into the guide unit.

In addition, according to an aspect of the present invention, there is provided a transfer belt unit, which is mounted in an image forming device by being inserted in a predetermined direction into a guide unit provided in the image forming device and extending to the predetermined direction, the transfer belt unit comprising: a positioning means for positioning the transfer belt unit with respect to the image forming device in a state where the transfer belt unit is inserted into the guide unit; a grasping means for grasping the transfer belt unit when the transfer belt unit is inserted into the guide unit, the grasping means being placed on the rear side of the positioning means in a direction of inserting the transfer belt unit into the guide unit; and a holding means for holding the transfer belt unit with respect to the image forming device when the transfer belt unit is inserted into the guide unit by abutting on a guide surface of the guide unit together with the positioning means before the grasping means is inserted into the guide unit.

In addition, according to an aspect of the present invention, there is provided an image forming device comprising: a transfer belt unit with the configuration as described above; a photoreceptor that transfers a toner image to a belt surface of a transfer belt configuring the transfer belt unit; and a transfer roller that transfers the toner image transferred to the belt surface of the transfer belt to a sheet.

In addition, according to an aspect of the present invention, there is provided a transfer belt unit holding method comprising: positioning a transfer belt unit with respect to an image forming device by a positioning member provided in the transfer belt unit, the transfer belt unit being in a state of being inserted in a predetermined direction in a guide unit provided in the image forming device and extending in the predetermined direction; and holding the transfer belt unit with respect to the image forming device when the transfer belt unit is inserted into the guide unit by making a guiding member provided in the transfer belt unit abut a guide surface of the guide unit together with the positioning member before a handle that allows to a user to grasp the transfer belt unit when the transfer belt unit is inserted into the guide unit and that is placed on the rear side of the positioning member in the direction of inserting the transfer belt unit into the guide unit is inserted in the guide unit.

DESCRIPTION OF THE PREFERRED EMBODIMENTS

Figure 1:
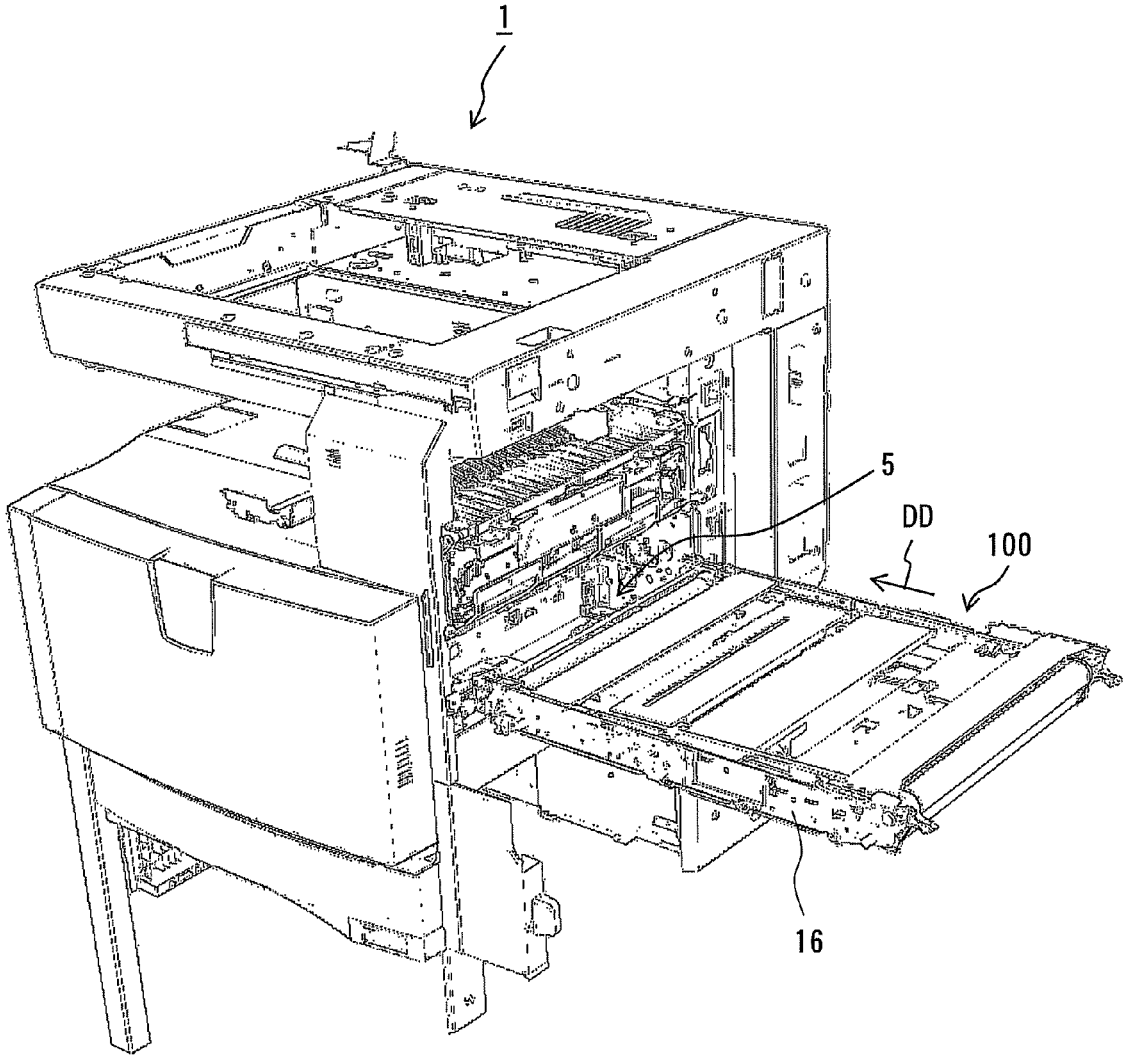
FIG. 1 is an outline view showing an image forming device to which a transfer belt unit of the present invention is applied and the transfer belt unit.
Figure 2A:
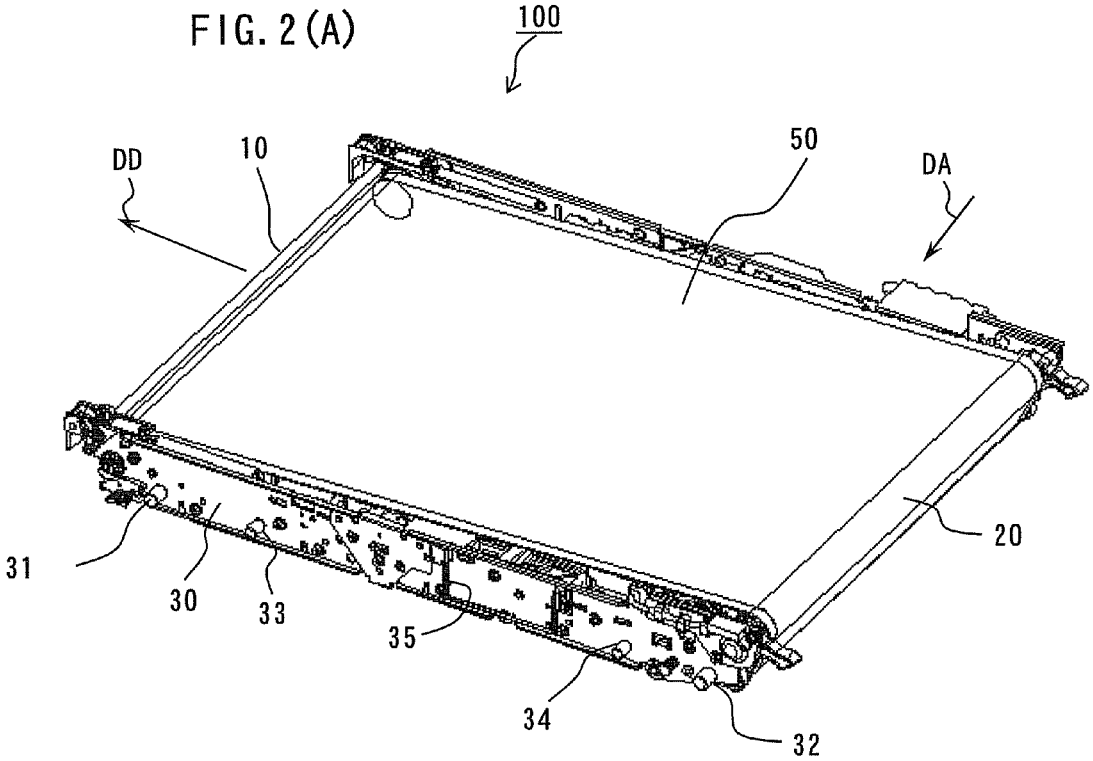
FIG. 2A is a perspective view showing a detail of the transfer belt unit of FIG. 1 by enlarging the transfer belt unit.
Figure 2B:
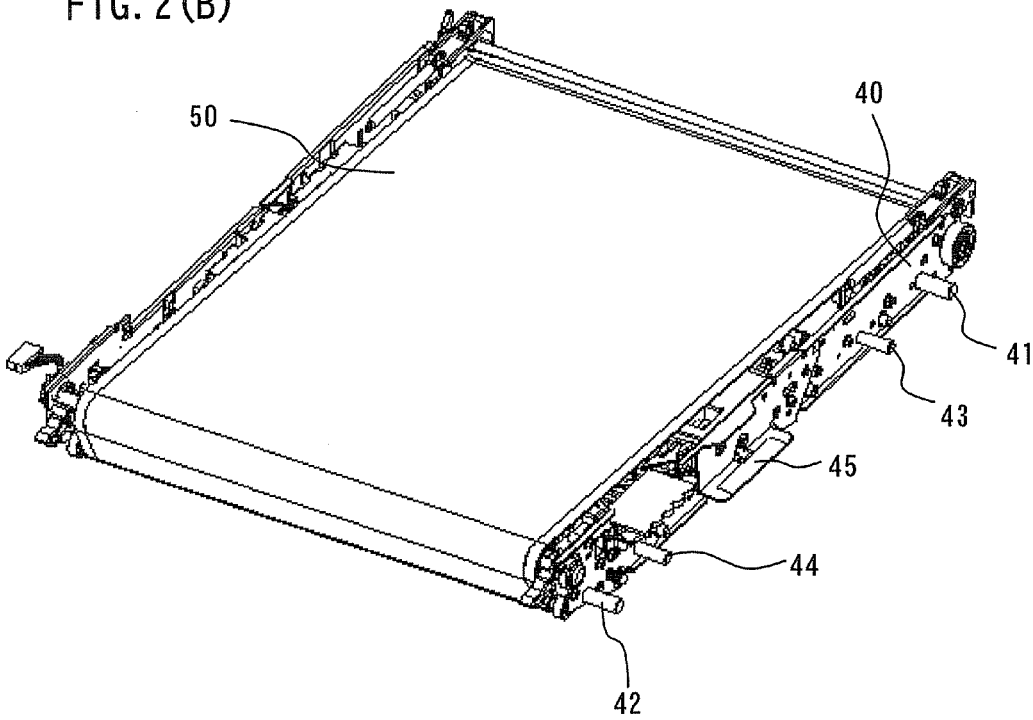
FIG. 2B is a perspective view showing the transfer belt unit of FIG. 2A viewed from a direction of an arrow DA.
Figure 3:
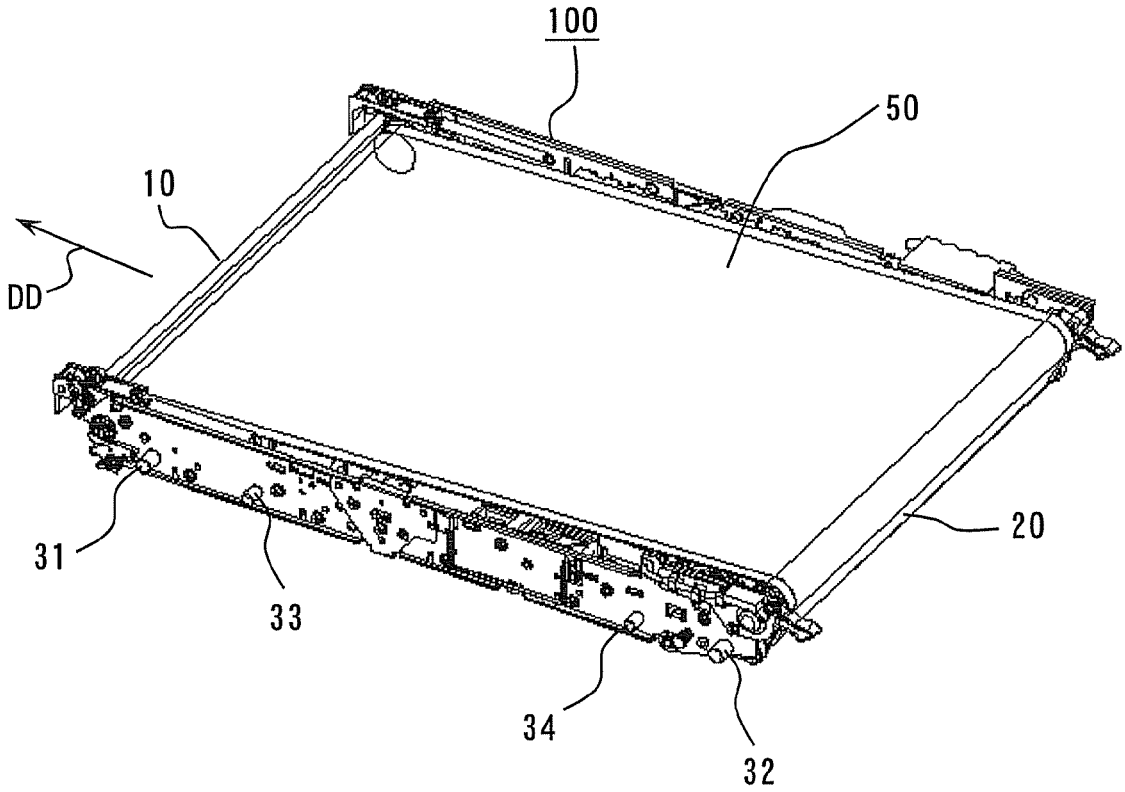
FIG. 3 is a perspective view for describing a relationship between a guide rail and the transfer belt unit placed in the image forming device of FIG. 1.
Figure 4:
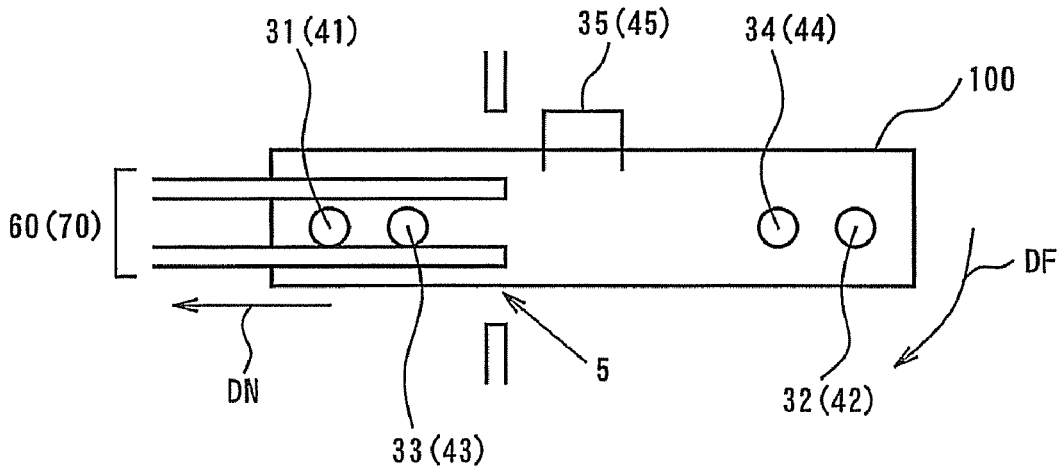
FIG. 4 is a cross-sectional view for describing an operational relationship between a positioning axis and a unit supporting axis shown in FIGS. 2 and 3, and a guide rail.
Figure 5:
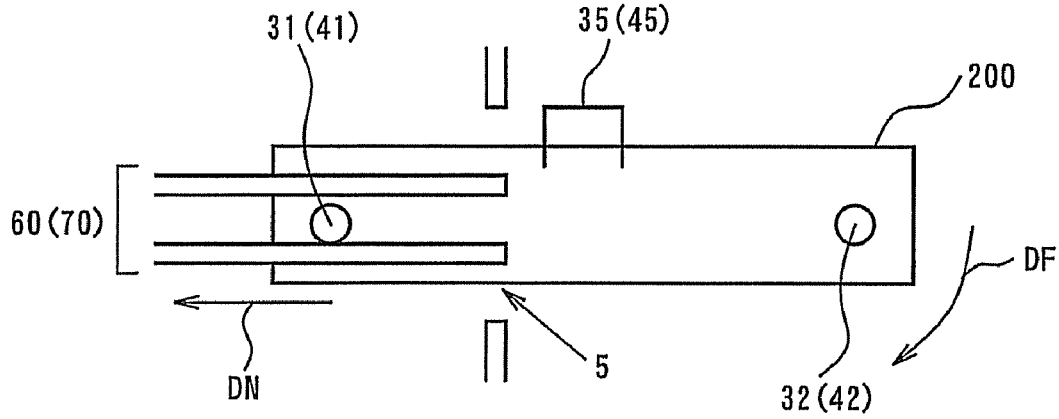
FIG. 5 Conventional Art
FIG. 5 is a cross-sectional view for explaining an operational relationship between the positioning axis and the guide rail of a conventional transfer belt unit.

Hereinafter, an embodiment of the present invention will be described with reference to accompanying drawings. FIG. 1 is an outline view showing an image forming device and a transfer belt unit. FIG. 2A is a perspective view showing a detail of the transfer belt unit of FIG. 1 by enlarging the transfer belt unit. FIG. 2B is a perspective view showing the transfer belt unit of FIG. 2A viewed from a direction of an arrow DA. FIG. 3 is a perspective view for describing a relationship between a guide rail (guide unit) and the transfer belt unit placed in the image forming device of FIG. 1. FIG. 4 is a cross-sectional view for describing an operational relationship between a positioning axis and a unit supporting axis shown in FIGS. 2 and 3, and a guide rail.

In a transfer belt unit 100 shown in FIGS. 1 to 3, an endless transfer belt 50 is stretched between rollers placed at a front surface 10 in an inserting direction and a rear surface 20 in the inserting direction, respectively, and is rotationally driven between the rollers. Handles (grasping units, grasping means) 35 and 45 are mounted at positions suitable for a weight balance, which are the center portions of the side surfaces of the transfer belt unit 100 (rear side of a positioning axis in the direction of inserting the transfer belt unit into the guide rail, and a substantial center of gravity in the direction of inserting the transfer belt unit into the guide rail). The operator uses the handles to hold the transfer belt unit when inserting the transfer belt unit into the guide rail.

The handle 45 on a right side surface 40, which is on the right-hand side as viewed from the rear of the insertion toward the front of the insertion, is molded by pressing a metal plate. On the other hand, the handle 35 on a left side surface 30 is molded by a metal wire of a spring material. The handle 35 works as a handle when raised from the side surface. However, when the handle 35 is released from the operator's hand, the handle 35 closely contacts the left side surface 30 by a spring force.

Positioning axes (positioning members, positioning means) 31, 32, 41, and 42 (for example, axes with a circular cylindrical shape), which are upstanding outwardly, are mounted on the left and right side surfaces 30 and 40 in positions near the front surface 10 and the rear surface 20 of the transfer belt unit 100 in the inserting direction, respectively. The positioning axes have a role of positioning the transfer belt unit in the image forming device in a state where the transfer belt unit is inserted into the guide rail.

In addition, unit supporting axes (guiding members, holding means) 33 and 43, which are upstanding outwardly, are mounted respectively on the side surfaces 30 and 40 between the positions of the positioning axes 31 and 41 placed near the front surface 10 of the transfer belt unit in the inserting direction and the center positions of the left and right side surfaces 30 and 40 (for example, positions where the handles 35 and 45 are mounted) (between the handles and the positioning axes of the transfer belt unit in the inserting direction in the guide rail).

In addition, unit supporting axes 34 and 44, which are upstanding outwardly, are mounted respectively on the side surfaces 30 and 40 between the positions of the positioning axes 32 and 42 placed near the rear surface 20 of the transfer belt unit in the inserting direction and the center positions of the left and right side surfaces 30 and 40 (for example, positions where the handles are mounted). In this case, the unit supporting axes 33 and 43 hold the transfer belt unit 100 in the course of being mounted in cooperation with the positioning axes 31 and 41. The unit supporting axes 34 and 44 facilitate the insertion of the rear part of the transfer belt unit in the inserting direction. Therefore, the role of the unit supporting axes 33 and 43 and that of the unit supporting axes 34 and 44 are different from each other.

A case of mounting the transfer belt unit 100 configured as described above in an image forming device 1, for example, will be described. While the handles 35 and 45 on the left and right of the transfer belt unit 100 are held, the transfer belt unit 100 is inserted into a unit inserting port 5 of the image forming device 1 from the front side 10 in the inserting direction in a direction of an arrow DD. In the unit inserting port 5, there are left and right guide rails 60 and 70 mounted in the image forming device 1 and extending toward the inside of the image forming device 1 from the left and right of the unit inserting port 5. The cross-sectional surfaces of the guide rails 60 and 70 are "U-shaped", and the openings of such "U-shape" face each other between the guide rails.

Accordingly, in order to mount the transfer belt unit 100 in the image forming device 1, the handles 35 and 45 of the transfer belt unit 100 are held, the positioning axes 31 and 41 located near the front surface 10 of the transfer belt unit 100 in the inserting direction are inserted in the "U-shape" of the guide rails 60 and 70, and then the transfer belt unit 100 is pushed inside the image forming device 1 horizontally. After the unit supporting axes 33 and 43 are inserted into the guide rails 60 and 70 subsequent to the positioning axes 31 and 41 near the front surface 10 in the inserting direction, and when the handles reach the unit inserting port, the handles cannot be held any longer. Therefore, the operator releases the handles from his or her hands and presses the rear surface of the transfer belt unit in the inserting direction or other parts thereof and pushes the transfer belt unit 100 into the reference position.

As described above, when the transfer belt unit 100 is inserted, the unit supporting axes 33 and 43 are inserted in the guide rails 60 and 70 subsequent to the positioning axes 31 and 41 of the front surface 10 in the inserting direction. After that, when the operator releases the handles 35 and 45 from his or her hands, the transfer belt unit 100 is held in the guide rails 60 and 70 by the positioning axes 31 and 41 and the unit supporting axes 33 and 43, as shown in FIG. 4. Therefore, the transfer belt unit 100 never rotates or falls as shown by an arrow DF. In this manner, when the transfer belt unit is inserted into the guide rails, the unit supporting axes abut a guide surface of the guide rails together with the positioning axes before the handles are inserted into the guide rails. Thereby, the unit supporting axes have a role of holding the transfer belt unit in the image forming device. In addition, the wording "before the handles are inserted in the guide rails" means, in other words, "before the handles are inserted in the guide rails to the extent that the handles are difficult to be held".

In this case, the unit supporting axes 34 and 44 are placed near the rear surface 20 in the inserting direction. Such placement is for facilitating the insertion of the positioning axes 32 and 42 in the guide rails. In this case, it is preferable that the size and position of the unit supporting axes 34 and 44 is set so that the unit supporting axes smoothly ride on the guide rails by corresponding to forms of a leading ends of the guide rails and help the rear surface side of the transfer belt unit in the inserting direction inserted further in the guide rails. That is, when the positioning axes 32 and 42 and the unit supporting axes 34 and 44 placed close to the rear surface 20 in the inserting direction approach the unit inserting port 5 of the image forming device 1, the unit supporting axes 34 and 44 first enter the guide rails 60 and 70 in such a manner as riding on the lower surface of the "U shape" of the guide rails 60 and 70, for example, and help the positioning axes 32 and 42 easily enter the guide rails 60 and 70. Here, the positioning axes 31, 32, 41, and 42 having a diameter 10 F and the unit supporting axes 33, 34, 43, and 44 having a diameter 8 F are used. As such, the dimension of the unit supporting axes in vertical directions (diameter here, because the unit supporting axes are a circular cylinder) at the time when the transfer belt unit is inserted into the guide rails are set smaller than that of the positioning axes.

As in the present embodiment, when a plurality of the unit supporting axes are arranged on the transfer belt unit in the direction of inserting the transfer belt unit into the guide rails, the unit supporting axes positioned on the rear side of the transfer belt unit in the direction of inserting the transfer belt unit into the guide rails among the plurality of the unit supporting axes may be set to have a smaller dimension in the up-and-down direction in the insertion than the unit supporting axes positioned on the front side. In this manner, the operation of inserting the transfer belt unit into the guide rails may be carried out more smoothly.

Preferably, the unit supporting axis 33 (43) is placed in the vicinity of the handle in the direction of inserting the transfer belt unit into the guide rails. In this manner, even when the operator releases his or her hands from the handles of the transfer belt unit while inserting the transfer belt unit into the guide rails, the transfer belt unit can be stably held by the positioning axis 31 (41) and the unit supporting axis 33 (43) by the "principle of leverage" with the positioning axis 31 (41) as the rotational center.

In the embodiment described above, an example where the positioning axes and the unit supporting axes have a cylindrical shape is shown. However, the present invention is not limited thereto. For example, the positioning axes and the unit supporting axes may have a cross section of an elliptical shape which has a longer diameter in the direction of inserting the transfer belt unit into the guide rails.

According to the present embodiment, an image forming device including the transfer belt unit having an effect described above, a photoreceptor transferring a toner image to the belt surface of the transfer belt configuring the transfer belt unit, and the transfer roller transferring the toner image transferred to the belt surface of the transfer belt to a sheet, can be provided.

Although the present invention has been described in detail by using specific embodiments, it is obvious to those skilled in the art that a variety of modifications and amendments can be made without departing from the spirit and the scope of the present invention.

As described above in detail, according to the present invention, a technology capable of contributing to an improvement of operability when the transfer belt unit is mounted in the image forming device can be provided.

What is claimed is:

1. A transfer belt unit, which is mounted in an image forming device by being inserted in a predetermined direction into a guide unit provided in the image forming device and extending to the predetermined direction, the transfer belt unit comprising:

a first positioning member that positions the transfer belt unit with respect to the image forming device in a state where the transfer belt unit is inserted into the guide unit, the first positioning member being placed near the front of the transfer belt unit and before a handle as viewed from the direction of the insertion of the unit;

a guiding member that holds the transfer belt unit with respect to the image forming device when the transfer belt unit is inserted almost horizontally into the guide unit by abutting on a guide surface, the guiding member together with the positioning member being placed before the handle as viewed from the direction of the insertion of the unit;

the handle that allows a user to grasp the transfer belt unit when the transfer belt unit is inserted into the guide unit, the handle being placed on the side surface of the transfer belt unit being downstream of the first positioning member as viewed from the direction of inserting the transfer belt unit into the guide unit; and a second positioning member that is placed downstream of the handle as viewed from the direction of the insertion of the unit, wherein a plurality of the guiding members are arranged in the direction of inserting the transfer belt unit into the guide unit, and the guiding members positioned on the rear side in the direction of inserting the transfer belt unit in the guide unit among the plurality of guiding members have a smaller dimension in the up-and-down direction at the time of the insertion than the guiding members positioned on the front side.

2. The transfer belt unit according to claim 1, wherein the handle is placed on a substantial center of gravity in the direction of inserting the transfer belt unit into the guide unit, and the guiding member is placed between the handle and the positioning member in the direction of inserting the transfer belt unit into the guide unit.

3. The transfer belt unit according to claim 2, wherein the guiding member is placed in the vicinity of the handle in the direction of inserting the transfer belt unit into the guide unit.

4. The transfer belt unit according to claim 2, wherein the guiding member has a smaller dimension in the up-and-down direction when the transfer belt unit is inserted into the guide unit than the positioning member.

5. A transfer belt unit, which is mounted in an image forming device by being inserted in a predetermined direction into a guide unit provided in the image forming device and extending to the predetermined direction, the transfer belt unit comprising:

positioning means for positioning the transfer belt unit with respect to the image forming device in a state where the transfer belt unit is inserted into the guide unit;

grasping means for allowing a user to grasp the transfer belt unit when the transfer belt unit is inserted into the guide unit, the grasping means being placed on the rear side of the positioning means in a direction of inserting the transfer belt unit into the guide unit;

guiding means for guiding the transfer belt unit into an insertion port of the image forming device in an almost horizontal direction; and holding means for holding the transfer belt unit with respect to the image forming device when the transfer belt unit is inserted into the guide unit by abutting on a guide surface of the guide unit together with the positioning means before the grasping means is inserted into the guide unit, wherein a plurality of the holding means are placed in the direction of inserting the transfer belt unit into the guide unit, and among the plurality of the holding means, a guiding member positioned on the rear side in the direction of inserting the transfer belt unit into the guide unit has a smaller dimension in the up-and-down direction at the time of inserting the transfer belt unit into the guide unit than a guiding member positioned on the front side.

6. The transfer belt unit according to claim 5, wherein the grasping means is placed in a substantial center of gravity of the transfer belt unit in the direction of inserting the transfer belt unit into the guide unit, and the holding means is placed between the grasping means and the positioning means in the direction of inserting the transfer belt unit into the guide unit.

7. The transfer belt unit according to claim 6, wherein the holding means is placed in the vicinity of the grasping means in the direction of inserting the transfer belt unit into the guide unit.

8. The transfer belt unit according to claim 6, wherein the holding means has a smaller dimension in the up-and-down direction at the time of inserting the transfer belt unit into the guide unit than the positioning means.

9. A transfer belt unit holding method comprising:

positioning a transfer belt unit, which is in a state of being inserted in a predetermined direction in a guide unit provided in an image forming device and extending to the predetermined direction, with respect to the image forming device by a first positioning member provided in the transfer belt unit; and holding the transfer belt unit with respect to the image forming device when the transfer belt unit is inserted in the guide unit by making a guiding member provided in the transfer belt unit abutting a guide surface of the guide unit together with the positioning member before a handle that allows a user to grasp the transfer belt unit when the transfer belt unit is inserted almost horizontally in the guide unit and that is placed on the rear side of the positioning member in the direction of inserting the transfer belt unit into the guide unit is inserted in the guide unit, wherein a plurality of the guiding members are placed in the direction of inserting the transfer belt into the guide unit, and among the plurality of the guiding members, a guiding member positioned on the rear side in the direction of inserting the transfer belt unit into the guide unit has a smaller dimension in the up-and-down direction at the time of inserting the transfer belt unit into the guiding member than a guiding member positioned on the front side.

10. The transfer belt unit holding method according to claim 9, wherein the handle is placed in a substantial center of gravity in the direction of inserting the transfer belt unit into the guide unit, and the guiding member is placed between the handle and the positioning member in the direction of inserting the transfer belt unit into the guide unit.

11. The transfer belt unit holding method according to claim 10, wherein the guiding member is placed in the vicinity of the handle in the direction of inserting the transfer belt unit into the guide unit.

12. The transfer belt unit holding method according to claim 10, wherein the guiding member has a smaller dimension in the up-and-down direction at the time of inserting the transfer belt unit into the guide unit than the positioning member.

* * * * *